US005833476A

United States Patent [19]

Sakamaki

[11] Patent Number: 5,833,476

[45] **Date of Patent: *Nov. 10, 1998**

[54] ROTARY CONNECTOR APPARATUS

[75] Inventor: Takashi Sakamaki, Tokyo, Japan

[73] Assignee: Niles Parts Co., Ltd., Japan

[ * ] Notice: The term of this patent shall not extend beyond the expiration date of Pat. No. 5,645,441.

[21] Appl. No.: 803,516

[22] Filed: Feb. 20, 1997

Related U.S. Application Data

[63] Continuation-in-part of Ser. No. 444,040, May 18, 1995, Pat. No. 5,645,441.

[30] Foreign Application Priority Data

Mar. 1, 1996 [JP] Japan ..... 8-071369

[51] Int. Cl.[6] ..... H01R 35/04

[52] U.S. Cl. ..... 439/164; 439/15

[58] Field of Search ..... 439/164, 15, 809

[56] References Cited

U.S. PATENT DOCUMENTS

| | | | |
|---|---|---|---|
| 2,735,080 | 2/1956 | Littman | 439/809 |
| 4,060,305 | 11/1977 | Poliak et al. | 439/809 |
| 4,632,491 | 12/1986 | Lutz | 439/809 |
| 5,514,006 | 5/1996 | Getselis et al. | 439/417 |
| 5,645,441 | 7/1997 | Okuhara et al. | 439/164 |

FOREIGN PATENT DOCUMENTS 7-263105 10/1995 Japan .

*Primary Examiner*—Gary F. Paumen

*Attorney, Agent, or Firm*—Ronald P. Kananen; Rader, Fishman & Grauer

[57] ABSTRACT

A rotary connector apparatus having an improved structure for connecting a flexible cable 4 of the apparatus with a wire harness 7. The rotary connector apparatus includes a stator housing 1 and a rotor housing 2 rotatably mounted on the stator housing 1. The flexible cable 4 is received in a spiral formation within a space formed between the stator housing 1 and the rotor housing 2. A terminal 5 is electrically connected to an electric wire 4*a* exposed from the flexible cable 4. A supporter 6 is molded with the terminal 5 and fixed to at least one of the stator housing 1 and the rotor housing 2. The wire harness 7 is electrically connected to the terminal 5 by welding or the like. The supporter 6 has a holding portion 6*b*, 13*a* in the form of a through hole 6*b*, 13*a* into which a core wire 7*a*, 11*b* or a coating film 7*d* at the end point of the harness is inserted. The holding portion 6*b*, 13*a* facilitates welding of the flexible cable to the wire harness by preventing individual strands of the core wire from scattering.

10 Claims, 4 Drawing Sheets

ROTARY CONNECTOR APPARATUS

CROSS-REFERENCE TO RELATED APPLICATION

The present application is a continuation in part of U.S. application Ser. No. 08/444,040 filed May 18, 1995, now U.S. Pat. No. 5,645,441.

BACKGROUND OF THE INVENTION

1. Field of the Invention

The present invention relates generally to a rotary connector apparatus mounted on, for example, a pad portion of an automotive steering wheel for supplying electric power to an air bag or the like. More specifically, the present invention relates to an improvement of a structure for connecting the flexible cable of the rotary connector apparatus with a wire harness.

2. Description of the Related Art

A conventional rotary connector apparatus is disclosed, for example, in Japanese Patent Publication No. JP A-7-263105. The external connection harness of the conventional rotary connector apparatus has a plurality of core wires fixed on each terminal piece using an electric resistance welding method, an ultrasonic wave welding method, or the like.

However, a problem exists when connecting the external connection harness of the conventional rotary connector apparatus. Specifically, in the external connection harness of the conventional rotary connector apparatus, when each of the core wires is welded on each terminal piece, the multiple strands of the core wires are scattered as shown in the drawings of the above-mentioned Japanese Patent Publication No. JP A-7-263105, thereby resulting in an unstable quality of the welded portion. To overcome this problem, the conventional core wire of the external connection harness has been fixed by using a compression press work, a soldering work, a return work, or the like in order to prevent scattering at the welded portion.

However, when the core wire in the external connection harness of the rotary connector apparatus is fixed at the welded portion by using the compression press work, the welding work, the return work or the like, the number of process steps and manufacturing cost is undesirably increased.

SUMMARY OF THE INVENTION

It is an object of the present invention to provide an improved rotary connector apparatus that overcomes the problems associated with the conventional rotary connector apparatus described above.

More specifically, it is an object of the present invention to fix the core wire of a wire harness of a rotary connector to a wire harness by providing a holding portion in the form of a through hole for holding the end point of the wire harness on a supporter.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, a rotary connector apparatus is provided comprising: a stator housing; a rotor housing mounted rotatably on the stator housing; a flexible cable received in a spiral formation within a space formed between the stator housing and the rotor housing; a terminal electrically connected to an electric wire exposed from the flexible cable; a supporter molded with the terminal and fixed on at least one of the stator housing and the rotor housing; and a harness connected to the terminal. The rotary connector apparatus is characterized by the supporter having a through hole into which a core wire or a coating film at an end point of the wire harness is inserted.

The supporter preferably has a recess portion formed therein. A welding portion of the terminal is exposed in the recess portion. A press groove is formed in the supporter into which a coating film of the wire harness is inserted, the press groove being located adjacent to the recess portion.

In a first embodiment of the present invention, the through hole extends through the recess portion of the supporter adjacent to the terminal, and a coating film covers the end point of the core wire inserted into the through hole.

In a second embodiment of the present invention, the through hole extends through the recess portion of the supporter adjacent to the terminal, and the end point of the core wire inserted into the through hole is exposed, thereby increasing a contact area between said core wire and said terminal.

In a third embodiment of the present invention, the through hole is formed through the terminal, which is formed within the supporter by insert molding.

In accordance with another aspect of the present invention, a rotary connector apparatus is provided which comprises a stator housing, a rotor housing mounted rotatably on the stator housing, a flexible cable received in a spiral formation within a space formed between the stator housing and the rotor housing, a terminal electrically connected to the flexible cable, a harness having at least one multistrand core wire electrically connected to the terminal, and a supporter molded with the terminal and fixed on at least one of the stator housing and the rotor housing. The rotary connector apparatus is characterized by the supporter comprising a through hole means for holding an end portion of the core wire and preventing individual strands of the core wire from scattering when a portion of the core wire adjacent to the end portion is electrically connected to the terminal.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

Figure 1:
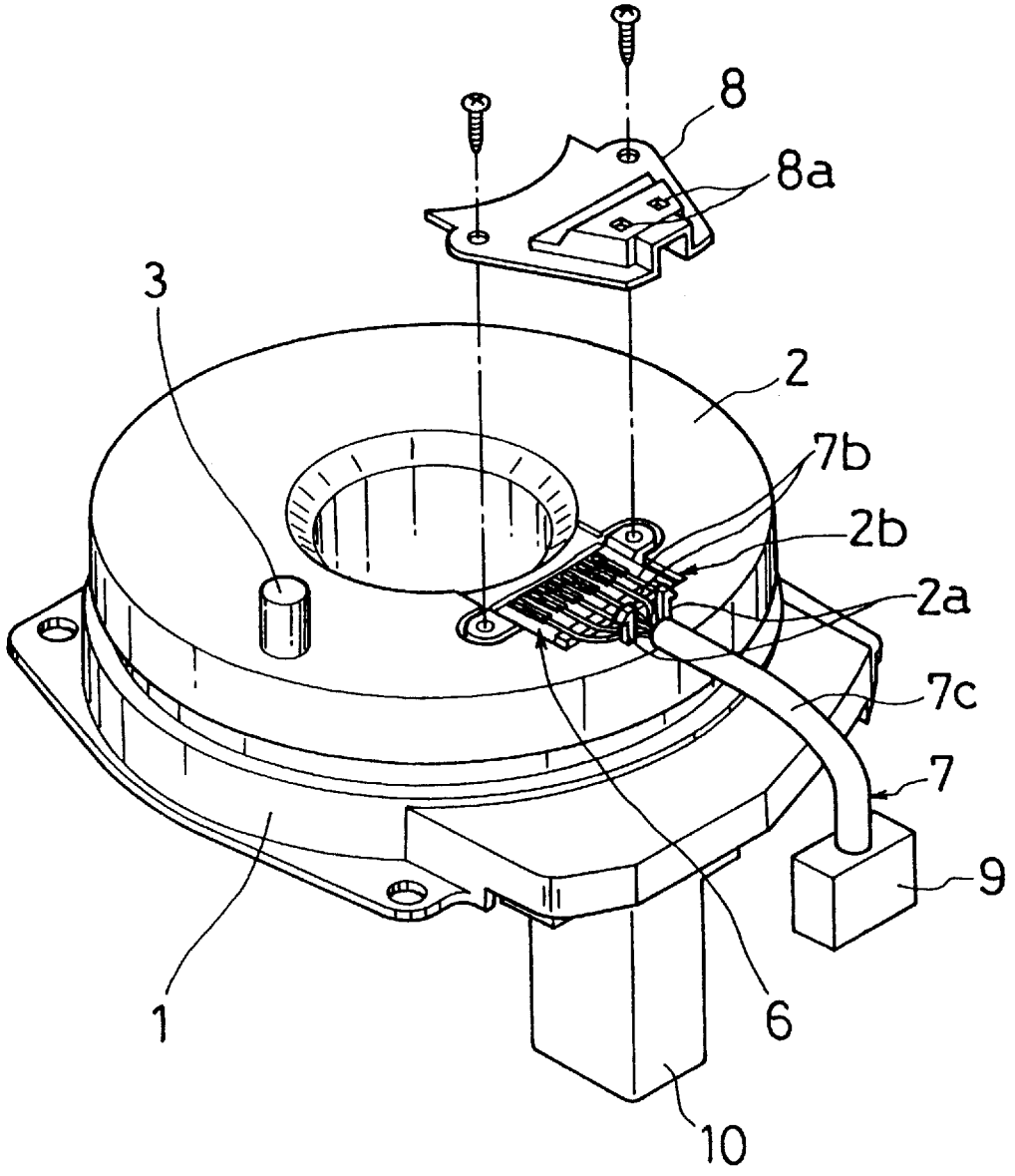
FIG. 1 is an exploded perspective view showing a rotary connector apparatus according to a first embodiment of the present invention.

A first embodiment of the present invention will now be described, by way of example, with reference to FIGS. 1 to 5 of the accompanying drawings.

The rotary connector apparatus includes a stator housing 1 mounted on a combination switch of, for example, an automobile. A rotor housing 2 is rotatably mounted on the stator housing 1 and coupled to a steering wheel (not shown) by using a connection pin 3. The rotor housing 2 is provided with the connection pin 3 and a pair of resilient claws 2*a* on which a cover 8 is mounted.

At the portion adjacent to the resilient claws 2*a*, a mounting hole 2*b* is provided in order to mount the supporter 6. The supporter 6 is disposed under the mounting hole 2*b*, and the cover 8 is disposed above the mounting hole 2*b*. The peripheral portion of the mounting hole 2*b* is secured by the supporter 6 and the cover 8. The connection pin 3 is projected from the upper surface of the rotor housing 2 and coated by a resilient rubber or the like.

Figure 3:
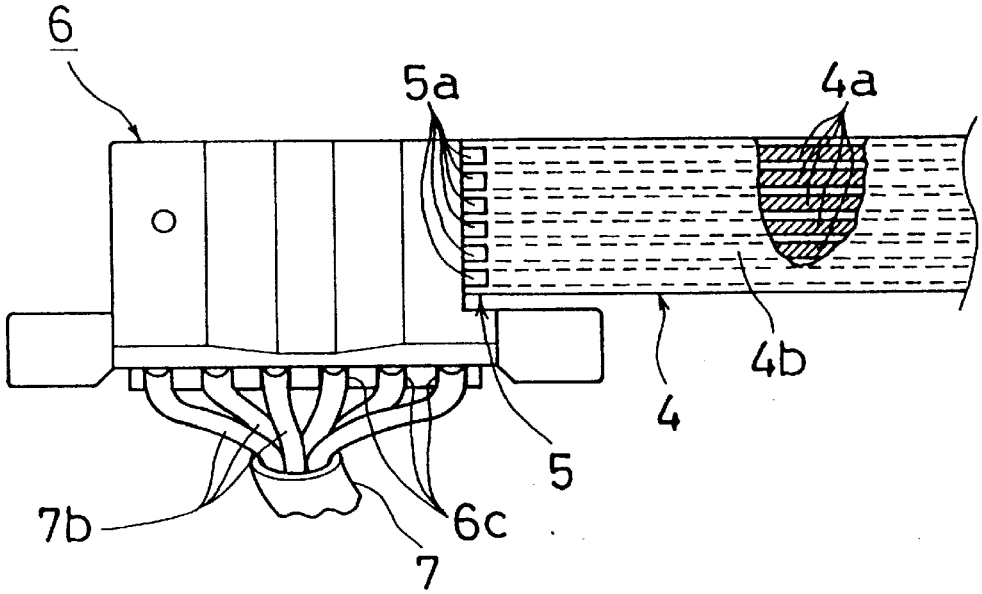
FIG. 3 is a side view showing the supporter according to the first embodiment of the present invention.

The flexible cable 4 is, as shown in FIG. 3, a so-called flat cable having electric wires 4*a* that are molded together by a resin film 4*b*. The flexible cable 4 is received within the doughnut-shaped space formed between the stator housing 1 and the rotor housing 2. One end of the flexible cable 4 is connected with the stator housing 1, and the other end thereof is connected with the rotor housing 2, respectively.

Figure 2:
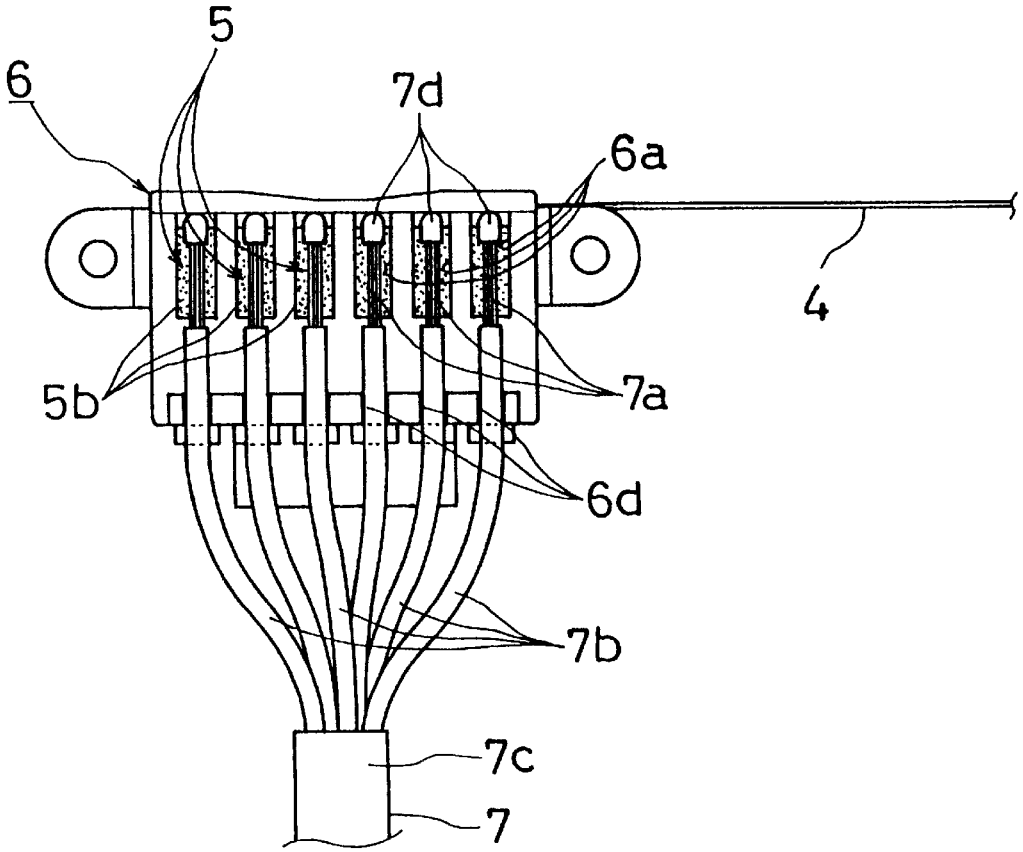
FIG. 2 is a plan view showing the supporter according to the first embodiment of the present invention.
Figure 4:
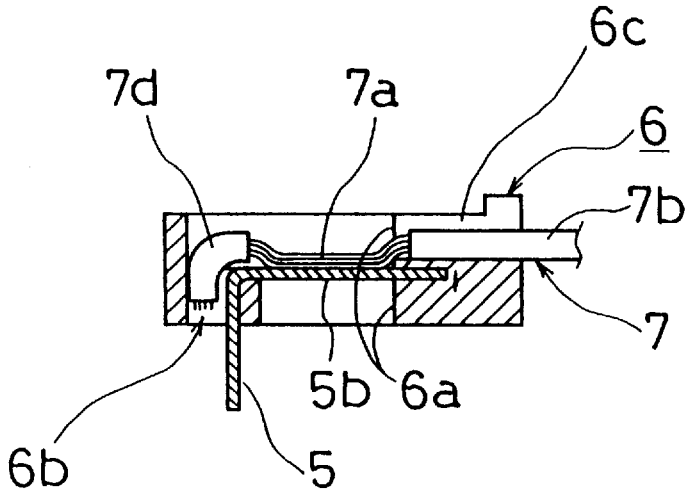
FIG. 4 is an enlarged sectional view showing the supporter according to the first embodiment of the present invention.
Figure 5:
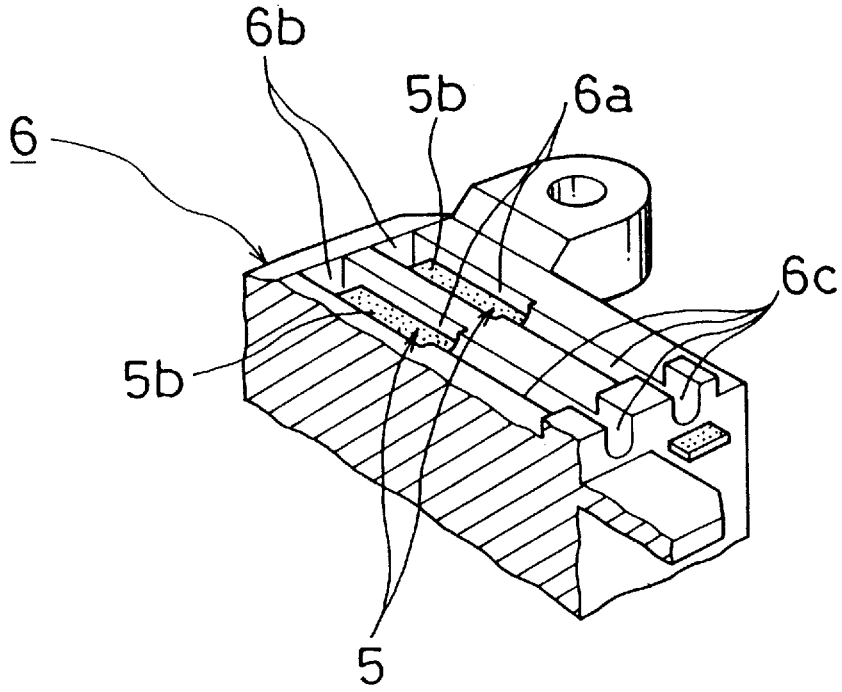
FIG. 5 is an enlarged perspective view showing the main portion of the supporter in which the wire harness is removed according to the first embodiment of the present invention.

A terminal 5 is made of a metallic material, such as copper or the like, and molded within the L-shaped resin supporter 6 by using an insert molding method. The terminal 5 has a plurality of terminal pieces 5*a* to be connected to each of the electric wires 4*a*, which are arranged in parallel within the flexible cable 4. The terminal 5 also has a plurality of welding portions 5*b* to be connected to each of the core wires 7*a* of the wire harness 7. The terminal pieces 5*a* provide a connecting portion for the electric wires 4*a*, which connecting portion is projected from the supporter 6 as shown in FIG. 3. The welding portion 5*b* is exposed within the recess portion 6*a* of the supporter 6, as shown in FIGS. 2, 4 and 5, and fixed with the core wire 7*a* by using electric resistance welding, ultrasonic wave welding, or the like.

The supporter 6 is made of molded resin which is insert molded about the terminal 5. As shown in FIG. 1, the supporter 6 is fixed on the rotor housing 2. However, the supporter 6 can also be secured on the stator housing 1. As shown in FIG. 1, the wire harness 7 having a connector 9 at its end is mounted to the supporter 6 by passing through the mounting hole 2*b* from the lower surface of the rotor housing 2. The wire harness 7 is secured on the rotor housing 2 by fitting the cover 8 to the resilient claws 2*a*. The cover 8 is fixed on the supporter 6 by using screws. Thus, the supporter 6 serves as a junction member for electrically connecting the flexible cable 4 with the external connection harness 7.

The supporter 6 has the welding portion 5*b* of the terminal 5 in the recess portion 6*a*, and the through hole 6*b* at the portion adjacent to the recess portion 6*a*. The through hole 6*b* is provided for supporting the coating film 7*d* at the end point of the wire harness 7, which is inserted into the through hole 6*b*. The through hole 6*b*, the welding portion 5*b*, the recess portion 6*a*, and the press groove 6*c* of the supporter 6 are aligned on the same line.

The recess portion 6*a* is a hole provided for exposing each of the welding portions 5*b* of the terminal 5, which is inserted into the supporter 6 by using an insert molding method. The number of recess portions 6*a* in the supporter 6 is at least as large as the number of core wires 7*a* in the wire harness 7. The through hole 6*b* receives the coating film 7*d* made of resin or the like at the end point of the wire harness 7. The through hole 6*b* serves as a hole by which the core wire 7*a* is guided at the center position of the welding portion 5*b* in the recess portion 6*a*. The through hole 6*b* is disposed at the position adjacent a corner of the approximately L-shaped terminal 5. Moreover, the through hole 6*b* has a circle section, rectangular section, or the like into which each coating film 7*d*, or all of coating films 7*d*, is inserted. The structural formation of the through hole 6*b*, however, is not limited to the specific structure shown in the drawings. For example, the through hole 6*b* may be a plurality of holes into which each individual coating film 7*d* is inserted, or a single hole into which all of coating films 7*d* are inserted.

The wire harness 7 is composed of a plurality of core wires 7*a* having multiple strands coated with the coating film 7*b*, 7*d*. A tube 7*c* covers the core wires 7*a* and coating film 7*b*, except the exposed end portions which are coupled with the supporter 6 and terminal 5. As shown in FIG. 1, the wire harness 7 is coupled to the supporter 6 at its one end, and another end thereof is connected to the connector 9. Moreover, the wire harness 7 has, as shown in FIGS. 2 and 3, the supporter 6 forming the holding portion 6*b* for holding the end point of the wire harness 7.

As shown in FIGS. 2 and 4, the coating film 7*d* supports the wire harness 7 by inserting the coating film 7*d* into the through hole 6*b*. The length and the position of the coating film 7*d* are not limited to the specific structure shown in the drawings. Other arrangements where the wire harness 7 is supported by passing the coating film 7*d* through the through hole 6*b* can also be used.

The core wire 7*a* located rearward of the coating film 7*d* is stripped by using a cutter between the coating films 7*b* and 7*d*. The exposed core wire 7*a* is then welded to the welding portion 5*b* by using the electric resistance welding method, the ultrasonic wave welding method, or the like. The coating film 7*b* is supported such that the portion between the welding portion 5*b* and the tube 7*c* is fitted into the press groove 6*c*.

As shown in FIG. 1, the cover 8 is secured on the rotor housing 2 such that the contact holes 8*a* are contacted to the resilient claws 2*a* projected from the rotor housing 2 adjacent to the mounting hole 2*b*, and the cover 8 is screwed to the supporter 6 thereby closing the mounting hole 2*b*. The connector 9 is connected to a counter-side connector (not shown) of the steering wheel. A connector 10 is disposed at the lower surface of the stator housing 1 and may be formed as an integral body with the stator housing 1. The connector 10 is connected to the counter-side connector (not shown) mounted on the steering column or body of the automobile.

The operation of a first embodiment of the present invention as described above will now be described by reference to the process of connecting the wire harness 7 to the flexible cable 4.

In the wire harness 7, the tube 7*c* is stripped off from the end of the wire harness, and then the coating film 7*b* is stripped off from the core wire 7*a* leaving a coating film 7*d* at an end portion of the wire harness and an exposed portion of the core wire 7*a* between the coating film 7*d* and the coating film 7*b*. The one end of the core wire 7*a* is connected with the connector 9. The other end of the wire harness 7, as shown in FIGS. 2 to 4, is held such that the coating film 7*d* at the end point thereof is fitted into the through hole 6*b*. As shown in FIGS. 2 to 4, the exposed core wire 7*a* is disposed on the welding portion 5*b* at a portion adjacent the coating film 7*d* located at the end point of the wire harness 7. Each of the coating films 7*b* is held by being inserted into each of the press grooves 6*c*. The multiple strands of the core wire 7*a* in the wire harness 7 are prevented from scattering because the coating film 7*d* remains at the end point of the wire harness 7, and each end point is inserted into the through hole 6*b*. Therefore, the core wire 7*a* does not require any solder or press work for avoiding such scattering during assembly.

Each of the coating films 7*d* of the wire harness 7 is inserted into a respective through hole 6*b* to position each of the core wires 7*a* on each of the welding portions 5*b*, respectively. The coating film 7*b* within the press groove 6*c* holds the coating film 7*b* by being fitted into the press groove 6*c* with pressure.

In the wire harness 7, the coating film 7*b* and the coating film 7*d*, which are located at both ends of the exposed core wire 7*a* welded on the welding portion 5*b*, are held by the through hole 6*b* and the press groove 6*c*. By this structure, the exposed core wire 7*a* is aligned on the center portion of the welding portion 5*b* and fixed thereon. The core wire 7*a* is fixed to the welding portion 5*b* by using the electric resistance welding method, the ultrasonic wave welding method, or the like. The core wire 7*a* is prevented from scattering because the coating film 7*b* and the coating film 7*d* at the end point thereof are fixed at both sides of the exposed core wire 7*a* by the press groove 6*c* and through hole 6*b*, respectively. Therefore, the core wire 7*a* does not require any solder or press work for avoiding scattering, thereby reducing the number of work processes and the manufacturing cost.

When welding the core wire 7*a* to the wire harness on the welding portion 5*b*, it is unnecessary to hold the wire harness by using human hands, fastening members, or the like, thereby achieving an easy assembly operation and a reliable welding.

As shown in FIG. 3, each of electric wires 4*a* of the flexible cable 4 is connected to each terminal piece 5*a*, respectively. The other end of the flexible cable 4 is connected to the connector 10.

The supporter 6 provided with the flexible cable 4 and the wire harness 7 is mounted such that the connector 9 is passed through the mounting hole 2*b* of the rotor housing 2 from the lower side in FIG. 1. The cover 8 is mounted such that contact holes 8*a* of the cover 8 are fitted with the claws 2*a* provided on the rotor housing 2, respectively. The cover 8 is then fixed on the supporter 6 by using screws. By this arrangement, both the cover 8 and the supporter 6 grip the periphery portion of the mounting holes 2*b* and are fixed on the rotor housing 2.

The flexible cable 4 is received within the case composed of the stator housing 1 and the rotor housing 2, and the rotor housing 2 and the connector 9 are attached on the steering side of the rotary connector apparatus. The stator housing 1 and the connector 10 are attached on the automobile body side of the rotary connector apparatus.

Figure 6:
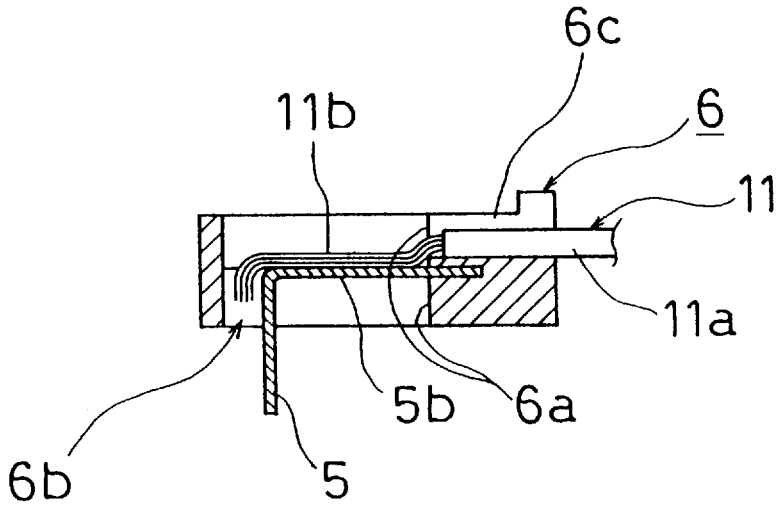
FIG. 6 is an enlarged sectional view showing the supporter according to a second embodiment of the present invention.

Referring now to FIG. 6, a second embodiment of the present invention will be described hereinafter. In FIG. 6, the same components which are present in the first embodiment are denoted by the same numerals as in the first embodiment. In the second embodiment shown in FIG. 6, a wire harness 11 is used which is similar to the wire harness 7 of the first embodiment, except that the coating film 7*d* at the end point of the wire harness 7 is removed.

The wire harness 11 has only an exposed core wire 11*b* at the end point of the coating film 11*a*. The coating film 11*a* is held by being fitted into the press groove 6*c*. The end point of the exposed core wire 11*b* is inserted into the through hole 6*b*. The portion of the exposed core wire 11*b* rearward of the through hole 6*b* is welded onto the welding portion 5*b*. Moreover, the supporter 6, including the through hole 6*b*, is the same as that shown in FIGS. 4 and 5 of the first embodiment. The structural formation and size of the through hole 6*b* is not limited to the specific structure shown in the drawings, as long as the through hole 6*b* allows the insertion of the end point of the core wire 11*b*.

Since the end point of the core wire 11*b* of the wire harness 11 is held by the through hole 6*b*, the multiple strands of the core wire 11*b* on the welding portion 5*b* are prevented from scattering during assembly. Therefore, it is unnecessary to use a solder, a press work, or the like to hold the multiple strands of the core wire 11*b* together. When welding the core wire 11*b* on the welding portion 5*b*, the end point of the core wire 11*b* is inserted into the through hole 6*b*, and the coating film 11*a* is pressed into the press groove 6*c*. Therefore, the core wire 11*b* is guided to the center position of the welding portion 5*b*, and both sides of the core wire 11*b* are held. It is unnecessary upon welding the core wire 11*b* on the welding portion 5*b* to hold the wire harness 11 by using human hands, fastening members, or the like, thereby simplifying a welding operation. Moreover, the area in which the core wire 11*b* contacts the terminal 5 becomes large, which results in a reliable electrical connection.

Figure 7:
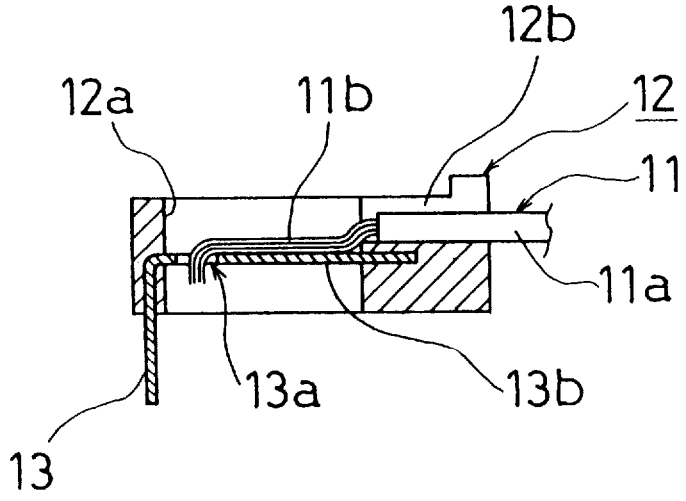
FIG. 7 is an enlarged sectional view showing the supporter according to a third embodiment of the present invention.

Referring now to FIG. 7, a third embodiment of the present invention will be described hereinafter. In FIG. 7, the same components which are present in the first and second embodiments are denoted by the same numerals as in the first and second embodiments. According to the third embodiment shown in FIG. 7, the core wire 11*b* of the wire harness 11 is held by a through hole 13*a* formed in the terminal 13.

The wire harness 11 of the third embodiment is the same as that of the second embodiment as shown in FIG. 6. The coating film 11*a* of the wire harness 11 is inserted into the press groove 12*b* of the supporter 12. The end point of the core wire 11*b* is inserted into the through hole 13*a*. A portion of the core wire 11*b* rearward of the through hole 13*a* is welded onto the welding portion 13*b* of the terminal 13.

In the supporter 12 shown in FIG. 7, the welding portion 13*b* of the terminal 13 is disposed in the recess portion 12*a*, and the through hole 13*a* for holding the exposed end point of the core wire 11*b* is formed in the terminal 13. The press groove 12*b*is a groove with a semi-circle section into which the coating film 11*a* can be inserted with pressure. The press groove 12*b* is adjacent to the recess portion 12*a*.

The terminal 13 has the welding portion 13*b* mounted with a through hole 13*a* in the recess portion 12*a* of the supporter 12. The terminal 13 is inserted into the supporter 12 by using an insert molding method. The exposed core wire 11*b* is passed through the circular through hole 13*a* and is mounted at the end portion of the welding portion 13*b* in the recess portion 12*b*. The structural formation and size of the through hole 13*a* is not limited to the specific structure shown in the drawings, as long as the through hole 13*a* allows the end point of the core wire 11*b* to be inserted therein. The supporter 12 includes the press groove 12*b* for holding the coating film 11*a* and the recess portion 12*a* for positioning the core wire 11*b*. The terminal 13 is formed within the supporter 12 by an insertion molding method or the like.

According to the third embodiment of the present invention, the wire harness 11 holds the end point of the core wire 11*b* by utilizing the through hole 13*a* formed in the terminal 13. Therefore, the multiple strands of the exposed core wire 11*b* on the welding portion 13*b* are prevented from scattering without using a solder, a press work, or the like. When the core wire 11*b* of the wire harness 11 is welded to the welding portion 13*b* of the terminal 13, the end point of the core wire 11*b* is inserted into or held by the through hole 13*a*, and the coating film 11*a* is inserted into the press groove 12*b*. Therefore, the core wire 11*b* is guided at the center position of the welding portion 5*b*, and both sides of the core wire 11*b* disposed on the welding portion 13*b* are held. The core wire 11*b* can be welded on the welding portion 13*b* without the use of human hands, a fastening member, or the like, to hold the wire harness 11, thereby achieving an easy welding operation. Moreover, since the core wire 11*b* is inserted into the through hole 13*a*, the area of the core wire 11*b* in contact with the terminal 13 becomes large, thereby achieving a reliable electric welding.

The rotary connector apparatus of the present invention having the structure described above has the following effects.

(1) The supporter is formed with a through hole into which the core wire at the end point of the wire harness or the coating film are inserted. Therefore, the wire harness may be guided and held at a desired position using the through hole, and upon welding the wire harness to the terminal, it is unnecessary to hold the wire harness by using human hands, a fastening member, or the like, thereby achieving an easy welding operation and a reliable welding.

(2) A recess portion is formed in the supporter, the welding portion of the terminal is exposed in the recess portion, and the through hole into which the end point of the core wire is inserted and supported is formed in the supporter. Therefore, the multiple strands of the core wire are prevented from scattering, and the core wire does not require any additional holding when welding the core wire onto the welding portion, thereby reducing the number of work processes and the manufacturing cost.

(3) The through hole is formed at the position adjacent to the terminal. Therefore, the core wire is guided to a desired position and fixed.

(4) The through hole is formed on the terminal inserted into the supporter. Therefore, when the core wire of the wire harness is welded onto the welding portion, the end point of the core wire is inserted into the through hole, and the core wire may be held at a desired position on the welding portion, thereby resulting in an easy welding operation. Moreover, by inserting the core wire into the through hole, the area in which the core wire is electrically connected to the terminal becomes large, thereby enabling a reliable electric connection.

(5) The supporter is provided with the press groove into which the coating film is inserted or fitted at the portion adjacent to the recess portion. Therefore, it is possible to hold both sides of the core wire to be welded on the terminal, and to guide and fix the core wire at the center position of the welding portion, thereby enabling an easy welding operation.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. A rotary connector apparatus, comprising:

a stator housing (1);

a rotor housing (2) mounted rotatably on said stator housing (1);

a flexible cable (4) received in a spiral formation within a space formed between said stator housing (1) and said rotor housing (2);

a terminal (5, 13) electrically connected to at least one electric wire (4*a*) exposed from said flexible cable (4);

a supporter (6, 12) molded with said terminal (5, 13) and fixed on at least one of said stator housing (1) and said rotor housing (2); and a harness (7, 11) connected to said terminal (5, 13), said harness having a plurality of core wires (7*a*, 11*b*), each core wire having a main portion coated with a coating film, an end portion, and an exposed contact portion between said coated main portion and said end portion;

wherein said supporter (6, 12) has at least one through hole (6*b*, 13*a*) into which said end portions of said core wires (7*a*, 11*b*) are inserted;

wherein said supporter (6, 12) has a plurality of recess portions (6*a*, 12*a*), and a plurality of welding portions (5*b*, 13*b*) of said terminal (5, 13) are exposed in said recess portions (6*a*, 12*a*), respectively, such that each welding portion is surrounded by a respective one of said recess portions;

wherein a plurality of parallel, U-shaped press grooves (6*c*, 12*b*) are formed in said supporter (6, 12), said main portion of each of said core wires of said wire harness (7, 11) being inserted into a respective one of said press grooves, said press grooves (6*c*, 12*b*) being located adjacent to said recess portions (6*a*, 12*a*), said welding portions being located between said at least one through hole and said press grooves; and wherein said exposed portion of each of said core wires is welded to a respective one of said welding portions of said terminal to establish an electrical connection therebetween.

2. The rotary connector apparatus according to claim 1, wherein said at least one through hole (6*b*) extends through said recess portions (6*a*) of the supporter (6) adjacent to the terminal (5), and coating film (7*d*) covers the end portions of each of the core wires inserted into the at least one through hole (6*b*).

3. The rotary connector apparatus according to claim 1, wherein said at least one through hole (6*b*) extends through said recess portions (6*a*) of the supporter (6) adjacent to the terminal (5), and the end portions of each of the core wires (11*b*) inserted into the at least one through hole (6*b*) are exposed, thereby increasing a contact area between said core wires (11*b*) and said terminal (5).

4. The rotary connector apparatus according to claim 1, wherein said at least one through hole (13*a*) is formed through the terminal (13), said terminal being formed within said supporter (12) by insert molding.

5. The rotary connector apparatus according to claim 1, wherein said end portions of said core wires are covered with a coating film and inserted into said at least one through hole.

6. A rotary connector apparatus, comprising:

a stator housing;

a rotor housing mounted rotatable on said stator housing;

a flexible cable received in a spiral formation within a space formed between said stator housing and said rotor housing;

a terminal electrically connected to said flexible cable;

a harness having at least one multi strand core wire electrically connected to said terminal; and a supporter molded with said terminal and fixed on at least one of said stator housing and said rotor housing, said supporter comprising a through hole means for holding an end portion of said core wire and preventing individual strands of said core wire from scattering when an exposed portion of said core wire adjacent to said end portion is electrically connected to said terminal;

wherein said supporter comprises a recess portion for exposing and surrounding a welding portion of said terminal, and a press groove for receiving a film coated portion of said core wire, said welding portion of said terminal being located between said through hole means and said press groove, said exposed portion of the core wire being welded to said welding portion of said terminal to establish an electrical connection therebetween.

7. The rotary connector apparatus according to claim 6, wherein said through hole means comprises a through hole formed between said supporter and said terminal, and said end portion of said core wire is inserted into said through hole.

8. The rotary connector apparatus according to claim 6, wherein said through hole means comprises a through hole formed in said terminal, and said end portion of said core wire is inserted into said through hole.

9. The rotary connector apparatus according to claim 6, wherein said end portion of said core wire which is inserted into said through hole means is covered by a coating film.

10. A rotary connector apparatus, comprising:

a stator housing;

a rotor housing mounted rotatably on said stator housing;

a flexible cable received in a spiral formation within a space formed between said stator housing and said rotor housing;

a terminal electrically connected to said flexible cable;

a harness having a plurality of multi strand core wires electrically connected to said terminal; and a supporter molded with said terminal and fixed on at least one of said stator housing and said rotor housing, said supporter comprising a plurality of through hole means for holding a respective end portion of each of said core wires and preventing individual strands of said core wires from scattering when an exposed portion of each of said core wires adjacent to said end portion is electrically connected to said terminal;

wherein said supporter comprises a plurality of recess portions for exposing and surrounding a plurality of welding portions of said terminal, respectively, a plurality of press grooves for receiving a respective film coated portion of each of said core wires, said welding portions of said terminal being located between said through hole means and said press grooves, said exposed portion of each of the core wires being welded to a respective one of the welding portions of said terminal to establish an electrical connection therebetween.

* * * * *